US006338353B1

(12) United States Patent
Chen

(10) Patent No.: US 6,338,353 B1
(45) Date of Patent: Jan. 15, 2002

(54) SELF-OPENING AND FOLDABLE UMBRELLA

(75) Inventor: Tien-Cheng Chen, Changhua Hsien (TW)

(73) Assignee: Ming Ho Umbrella Industry Co., Ltd., Changhua Hsien (TW)

( * ) Notice: Subject to any disclaimer, the term of this patent is extended or adjusted under 35 U.S.C. 154(b) by 0 days.

(21) Appl. No.: 09/551,751

(22) Filed: Apr. 18, 2000

(51) Int. Cl.[7] ..... A45B 25/14

(52) U.S. Cl. ..... 135/20.3; 135/25.1; 135/22; 135/24

(58) Field of Search ..... 135/16, 25.1, 20.3, 135/25.4, 22, 24, 28, 75

(56) References Cited

U.S. PATENT DOCUMENTS 5,791,359 A * 8/1998 Lin ..... 135/24
5,803,102 A * 9/1998 Ko ..... 135/24
5,806,545 A * 9/1998 Ko ..... 135/24
5,823,214 A * 10/1998 Seidel ..... 135/22
5,868,151 A * 2/1999 Kuo ..... 135/24
5,992,433 A * 11/1999 Kuang ..... 135/24
6,016,822 A * 1/2000 Lin ..... 135/24
6,035,873 A * 3/2000 Lin ..... 135/25.1
6,112,755 A * 9/2000 Lin ..... 135/24
6,145,522 A * 11/2000 Ko ..... 135/24
6,196,243 B1 * 3/2001 Chen ..... 135/22
6,199,571 B1 * 3/2001 Lin ..... 135/24

* cited by examiner

*Primary Examiner*—Beth A. Stephan
(74) *Attorney, Agent, or Firm*—Bacon & Thomas, PLLC

(57) ABSTRACT

A four-segment foldable umbrella comprises a shank, a rib assembly, an opening spring, a closing spring, a control mechanism, and a plurality of gores. The shank further comprises a top fulcrum, an outer pipe, a second middle pipe, a first middle pipe, an inner pipe, a handgrip. a long plastic pipe, and an outer pipe plug. The rib assembly consists of a plurality of top stretchers, lower ribs, inner connection ribs, middle ribs, inner resilient ribs, small slide sockets, outer resilient ribs, outer connection ribs, tail ribs, and a runner. An upper end or a lower end of the opening spring sustains a lower end of the outer pipe plug or props a long controller at its upper end respectively. The long controller, the inner pipe, and a main body sheathing the long plastic pipe are fixed by nailing the main body to the opening spring. Besides, the closing spring is disposed on the rib assembly.

1 Claim, 4 Drawing Sheets

SELF-OPENING AND FOLDABLE UMBRELLA

BACKGROUND OF THE INVENTION

To use a stick umbrella, a user has to push the runner of the umbrella to a predetermined position to open it. As the opening action takes a short period of time more or less, the user may get wetted in a heavy rain before he can open the umbrella. Therefore, various self-opening foldable umbrellas with multiple segments have been introduced to the market later on. In using the foldable umbrella of this kind, a user can open or close the umbrella more rapidly just by pressing a button on its shank.

SUMMARY OF THE INVENTION

The primary object of this invention is to provide a self-opening four-segment foldable umbrella, in which a shank comprises an outer pipe, a second middle pipe, a first middle pipe, an inner pipe, and a control mechanism for self-opening an umbrella.

In order to realize abovesaid object, the four-segment foldable umbrella of this invention comprises a shank, a rib assembly, an opening spring, a closing spring, a control mechanism, and a plurality of gores. The shank further comprises a top fulcrum, an outer pipe, a second middle pipe, a first middle pipe, an inner pipe, a handgrip, a long plastic pipe, and an outer pipe plug. The rib assembly consists of a plurality of top stretchers, lower ribs, inner connection ribs, middle ribs, inner resilient ribs, small slide sockets, outer resilient ribs, outer connection ribs, tail ribs, and a runner. An upper end or a lower end of the opening spring sustains a lower end of an outer pipe plug or props a long controller at its upper end respectively. One end of the closing spring disposed on the rib assembly is pivotally jointed with a nearer end of the top stretcher, and the other end is pivotally jointed to a return point of the inner resilient rib at a nearer end of the lower rib.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figures 1, 2:
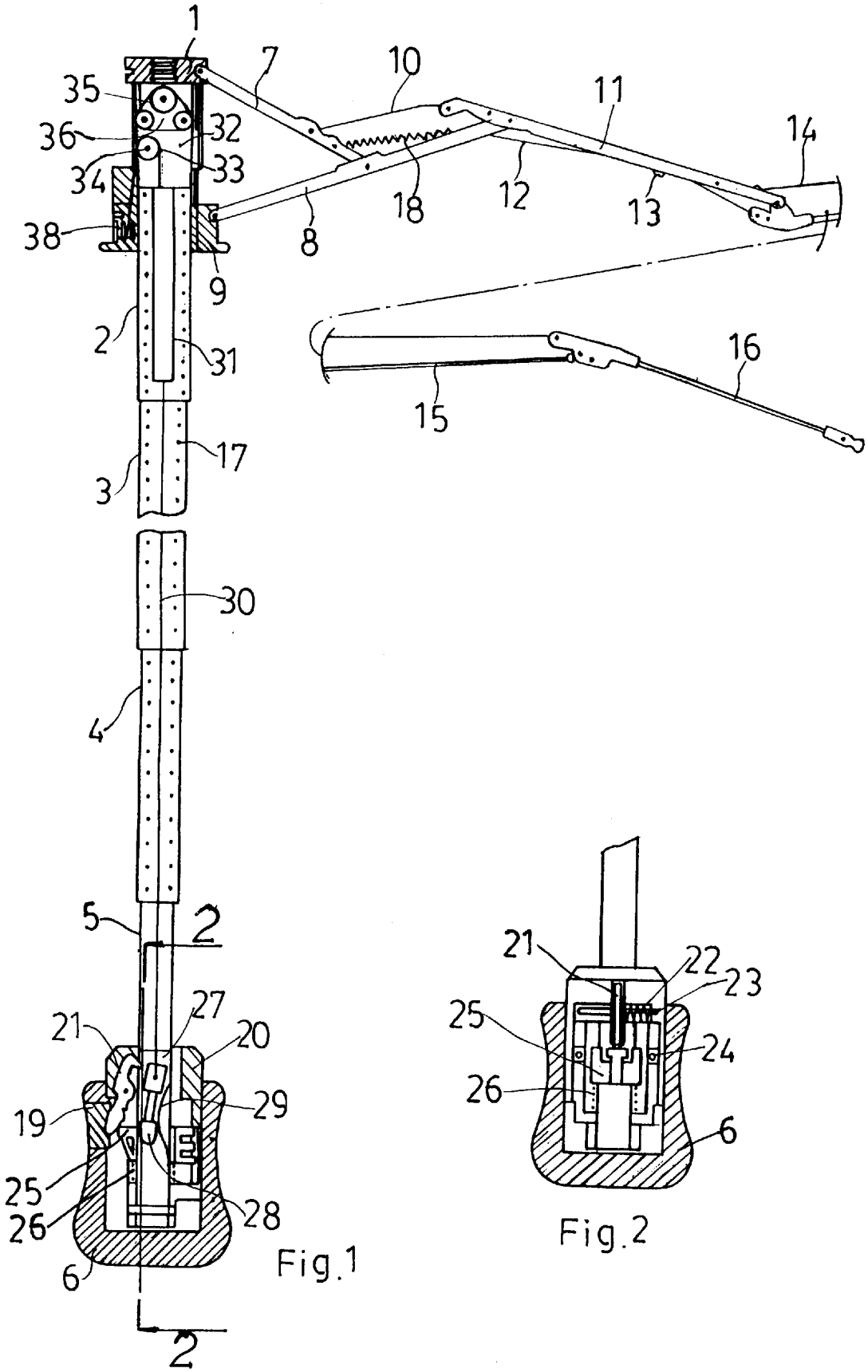
FIG. 1 is a cutaway sectional view showing an opened umbrella of this invention.
FIG. 2 is a cutaway sectional view of a handgrip of this invention.

As shown in FIG. 1, a four-segment foldable umbrella of this invention mainly comprises a shank, a rib assembly, an opening spring, a closing spring, a control mechanism, and a plurality of gores.

The shank is composed of a top fulcrum 1, an outer pipe 2, a second middle pipe 3, a first middle pipe 4, an inner pipe 5, a handgrip 6, a long plastic pipe 31, and an outer pipe plug 32.

Referring to FIG. 4 through FIG. 12, the cross section of the inner pipe 5 is circular, and the upper end of the inner pipe 5 is an equiangular quadrangle with a groove disposed in each corner to form an octagonal expanded portion 5'. The first middle pipe 4 with an octagonal cross-sectional portion 4' is inlaid in the expanded portion 5' and is tapered to a circular cross section at its lower end for sleeve-jointing with the inner pipe 5 while its upper end is reduced from the octagon with four grooves to become a quadrangular expanded arc portion 4". The cross section of the second middle pipe 3 is made in quadrangular arc shape sheathing the expanded portion 4" of the first middle pipe 4, wherein a quadrangular lower end of the second middle pipe 3 is provided with grooves to form an octagonal cross section 3' sheathing the first middle pipe 4, and a circular cross-sectional expended portion 3" is formed at its upper end. Moreover, a quadrangular arc-shaped cross section 2' is formed at a lower end of the outer pipe 2 sheathing the second middle pipe 3 while a circular cross section is formed at its upper end sheathing the expanded portion 3" of the second middle pipe 3, and besides, the long plastic pipe 31 linked with the plug 32 is arranged at the upper end of the outer pipe 2.

Figure 3:
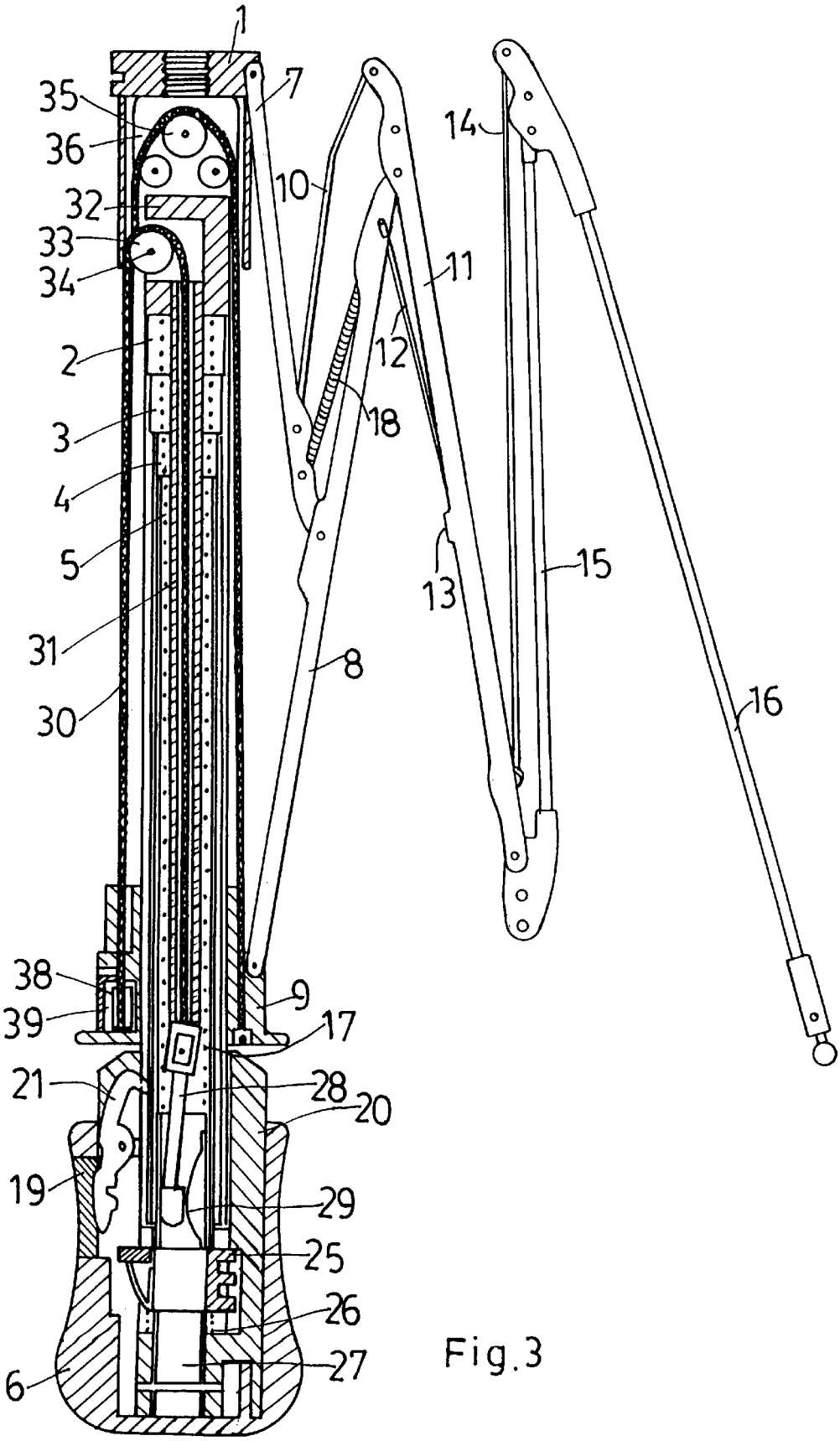
FIG. 3 is a cutaway sectional view showing a closed umbrella of this invention.
Figure 4:
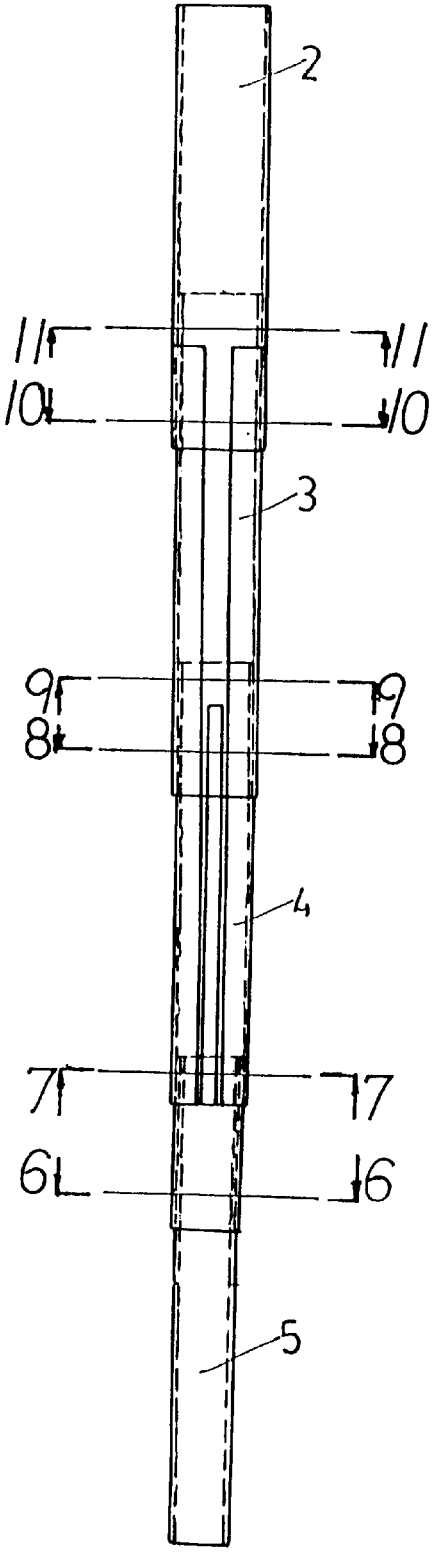
FIG. 4 is a front view of a shank of this invention.
Figure 5:
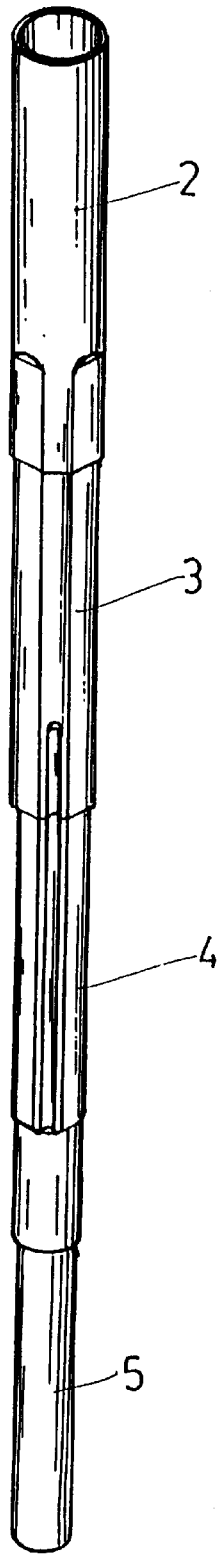
FIG. 5 is an elevational view of the shank of this invention in three dimensions.
Figure 6:
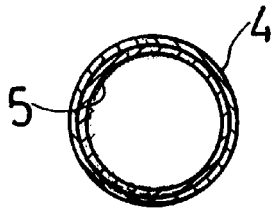
FIG. 6 is a cross-sectional view taken alone line 6—6 in FIG. 4.
Figure 10:
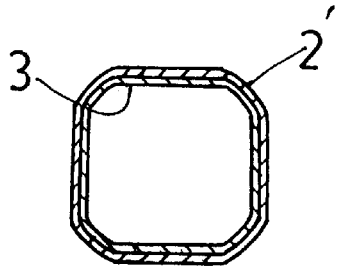
FIG. 10 is a cross-sectional view taken along line 10—10 in FIG. 4.
Figure 7:
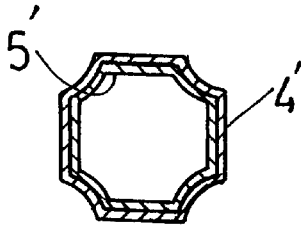
FIG. 7 is a cross-sectional view taken along line 7—7 in FIG. 4.
Figure 11:
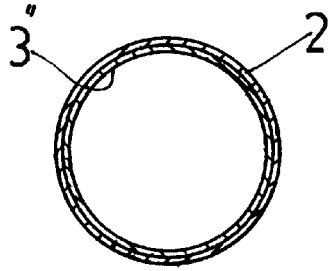
FIG. 11 is a cross-sectional view taken along line 11—11 in FIG. 4.
Figure 8:
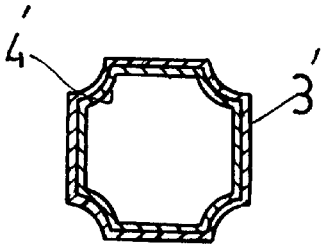
FIG. 8 is a cross-sectional view taken along line 8—8 in FIG. 4.
Figure 12:
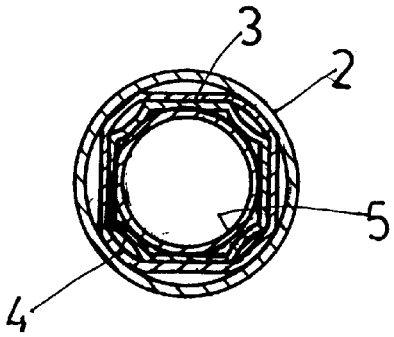
FIG. 12 is a cross-sectional view showing the shank in the closed umbrella.
Figure 9:
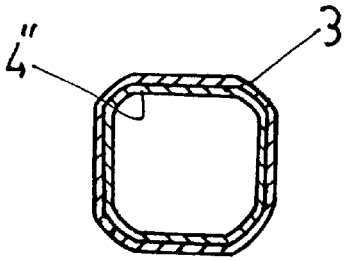
FIG. 9 is a cross-sectional view taken along line 9—9 in FIG. 4.

A rib assembly shown in FIGS. 1 and 3 consists of a plurality of top stretchers 7, lower ribs 8, inner connection ribs 10, middle ribs 11, inner resilient ribs 12, small slide sockets 13, outer resilient ribs 14, outer connection ribs 15, tail ribs 16, and a runner 9.

One end of the top stretcher 7 is pivotally jointed with the top fulcrum 1 of the shank, the other is pivotally jointed to a midpoint of the lower rib 8. One end of the lower rib 8 is pivotally jointed with the runner 9 on the shank, the other is pivotally jointed to one end of the middle rib 11. The other end of the middle rib 11 is in turn pivotally jointed with one end of the inner connection rib 10, and the other end of the inner connection rib 10 is pivotally jointed to the top stretcher 7 adjacent to the midpoint of the lower rib 8. The inner resilient rib 12 is laterally disposed at one side of the middle rib 11 and connected with one end of the outer connection rib 15 and a nearer end of the lower rib 8. The small slide socket 13 is formed by bending a projecting wall of the middle rib 11 to ensure that the inner resilient rib 12 will not be bent outwards. Further, one end of the outer resilient rib 14 is pivotally jointed with a nearer end of the middle rib 11, and the other end of the outer connection rib 15 and the outer resilient rib 14 are pivotally jointed to a nearer end of the tail rib 16.

An upper end or a lower end of the opening spring 17 sustains a lower end of the outer pipe plug 32 or props a long controller 27 at its upper end. The long controller 27, the inner pipe 5, and a main body 20 sheathing the long plastic pipe 31 are fixed by nailing the main body 20 to the opening spring 17. One end of the closing spring 18 disposed on the rib assembly is pivotally jointed with a nearer end of the top stretcher 7, and the other end is pivotally jointed to a return point of the inner resilient rib 12 at a nearer end of the lower rib 8. The control mechanism comprises a button 19, the main body 20, a bow piece 21, a twist reed 22, a twist-reed nail 23, two pieces of button spring 24, a control body 25, a spring of control body 26, the long controller 27, a snap spring piece 29, a pulling wire 30, the long plastic pipe 31, the outer pipe plug 32, and six small pulleys. The long controller 27 and the snap spring piece 29 are arranged in the inner pipe 5 while the twist reed 22, the bow piece 21, the twist-reed nail 23, and the button springs 24 are disposed on the main body 20. The button 19 is placed in the handgrip 6, and the long plastic pipe 31 is linked with the outer pipe plug 32, and one end of the pulling wire 30 is coupled with a snap head 28. After passing through the long plastic pipe 31, the outer pipe plug 32, and a guide wheel 33, the other end of the pulling wire 30 is led downwards to wind on a lower guide wheel 38, then led upwards to wind on three upper guide wheels 35 located above the outer pipe plug 32 at the top end of the outer pipe 2, and finally, led downwards farther and to be fixed at the runner 9. The guide wheel 33 and its axis pin 34 are pivotally disposed on the outer pipe plug 32 while the lower guide wheel 38 and its wheel socket 39 are fixed with a fixing element and disposed on the runner 9. Furthermore, the upper guide wheel 35 and its wheel socket 36 are fixed with a fixing element and disposed on the outer pipe plug 32. In addition, the axis of the upper guide wheel 35 is parallel to that of the guide wheel 33 while the axis of the lower guide wheel 38 is perpendicular to that of the guide wheel 33 and the upper guide wheel 35.

When opening the umbrella, a user is supposed to press the button 19 to lift up the bow piece 21, then the elastic force of the opening spring 17 enables the first middle pipe 4, the second middle pipe 3, the outer pipe 2, the top fulcrum 1 and the runner 9 of the shank to lift upwards relative to the inner pipe 5 to open the umbrella and meanwhile deform the closing spring 18. On the contrary, when closing the umbrella, the control body 25 is forced by its control spring 26 to move on top of the snap head 28 to push down the button 19, the bow piece 21, and the control body 25 for releasing the elastic force applied on the snap spring piece 29 and allowing the runner 9 to move downwards. At this moment, by taking advantage of the top stretcher 7, the lower rib 8, the runner 9, the inner connection rib 10, etc, the opening button is pressed to close the first middle pipe 4, the second middle pipe 3, the outer pipe 2, the top stretcher 7, the runner 9, and the umbrella accordingly.

Although, this invention has been described in terms of preferred embodiments, it is apparent that numerous variations and modifications may be made without departing from the true spirit and scope thereof, as set forth in the following claims.

What is claimed is:

1. A self-opening foldable umbrella, comprising:

a shank including a top fulcrum, an outer pipe, a second middle pipe, a first middle pipe, an inner pipe, a handgrip, a long plastic pipe, and an outer pipe plug;

a rib assembly including a plurality of top stretchers, lower ribs, inner connection ribs, middle ribs, inner resilient ribs, small slide sockets, outer resilient ribs, outer connection ribs, tail ribs, and a runner;

an opening spring having an upper end supporting a lower end of said outer pipe plug and a lower end connected to a long controller at an upper end of the long controller, wherein said long controller, said inner pipe, and a main body sheathing said long plastic pipe are fixed by nailing said main body to said opening spring;

a closing spring disposed on said rib assembly, wherein one end of said closing spring is pivotally joined with an end of said top stretchers, and another end of said closing spring is pivotally joined to a return point of said inner resilient ribs at an end of said lower ribs;

a control mechanism;

a plurality of gores;

said inner pipe having a circular cross section;

an upper end of said inner pipe being an equiangular quadrangle with a groove disposed in each corner thereof to form an octagonal expanded portion;

said first middle pipe having an octagonal cross-sectional portion inlaid in said octagonal expanded portion of said inner pipe and tapered to a circular cross section at its lower end for sleeve-joining with said inner pipe, and an upper end being reduced from the octagon with four grooves to a quadrangular expanded arc portion;

the cross section of said second middle pipe being of quadrangular arc shape for sheathing said expanded portion of said first middle pipe, a quadrangular lower end of said second middle pipe is provided with a plurality of grooves to form an octagonal cross section for sheathing said first middle pipe, and a circular cross-sectional expanded portion is formed at an upper end of said second middle pipe;

a quadrangular arc-shaped cross section being formed at a lower end of said outer pipe for sheathing said second middle pipe, and a circular cross section being formed at an upper end of said outer pipe for sheathing said expanded portion of said second middle pipe;

said long plastic pipe linked with said outer pipe plug and disposed at the upper end of said outer pipe; and said control mechanism including a button, the main body, a bow piece, a twist reed, a twist reed nail, two pieces of button spring, a control body, a control body spring, the long controller, a snap spring piece, a pulling wire, the long plastic pipe, the outer pipe plug, and six small pulleys, wherein the long controller and the snap spring piece are arranged in said inner pipe while the twist reed, the bow piece, the twist reed nail, and the button springs are disposed on said main body, the button being placed in said handgrip, the long plastic pipe being linked with the outer pipe plug, and one end of the pulling wire is coupled with a snap head.

* * * * *